US010494172B2

(12) United States Patent
Connelly

(10) Patent No.: US 10,494,172 B2
(45) Date of Patent: Dec. 3, 2019

(54) PORTABLE ASPHALT EMULSION STORAGE SYSTEM

(71) Applicant: RCM EQUIPMENT COMPANY, LLC, Hastings, MN (US)

(72) Inventor: Frank Connelly, Hastings, MN (US)

(73) Assignee: RCM Equipment Company, LLC, Hastings, MN (US)

( * ) Notice: Subject to any disclaimer, the term of this patent is extended or adjusted under 35 U.S.C. 154(b) by 152 days.

(21) Appl. No.: 15/092,926

(22) Filed: Apr. 7, 2016

(65) Prior Publication Data

US 2016/0298303 A1 Oct. 13, 2016

Related U.S. Application Data

(60) Provisional application No. 62/144,292, filed on Apr. 7, 2015.

(51) Int. Cl.
*B65D 88/74* (2006.01)
*B65D 88/12* (2006.01)
(Continued)

(52) U.S. Cl.
CPC ..... *B65D 88/745* (2013.01); *B65D 88/128* (2013.01); *B65D 88/744* (2013.01);
(Continued)

(58) Field of Classification Search
CPC .. B65D 71/0088; B65D 88/128; B65D 88/26; B65D 88/30; B65D 88/32; B65D 88/54; B65D 88/56; B65D 90/14; B28C 7/049; B28C 7/0495; B60P 1/6427; B60P 1/483; B60P 1/00; B60P 3/00; B65G 65/40; B65G 67/24; B65G 65/23; B65G 2814/0317; Y10S 366/606; Y10S 414/132; B65B 69/00; B65F 1/02; B65F 3/02; B65F 3/04; B65F 3/041; B65F 3/046; B65F 3/048; B65F 3/08; B65F 2003/023; B65F 1/122; B65F 65/23; B65F 65/40; B66F 9/19
USPC ..... 206/595; 414/332, 919, 425, 483, 491, 414/781, 406, 414, 441, 812, 21; 366/6–8, 18, 22–25, 141, 192, 42, 62, 63;
(Continued)

(56) References Cited

U.S. PATENT DOCUMENTS 2,056,179 A * 10/1936 Fitch ..... B60P 3/22 280/838
2,764,973 A * 10/1956 Miller ..... B67D 7/80 126/343.5 A (Continued)

*Primary Examiner* — Jeffrey A Shapiro
(74) *Attorney, Agent, or Firm* — Skaar Ulbrich Macari, P.A.

(57) ABSTRACT

Disclosed is a portable storage system for asphalt and other like material that is required to be maintained at a particular constant heated temperature even in sub-zero ambient temperatures. The system may include an exterior covering over a frame to define an enclosure. The frame defines an interior space where an insulated tank resides. The tank is heated. The interior of the enclosure may be heated. Rails provided along a vertical surface of the enclosure and extending above the roof of the enclosure allow the entire system to be loaded as a roll-off load on a truck. A plurality of lugs with apertures therethrough extend beyond the exterior surface of the enclosure to enable the enclosure to be lifted by cranes and tied down during transport.

20 Claims, 25 Drawing Sheets

(51) Int. Cl.
*B65D 90/00* (2006.01)
*B65D 90/16* (2006.01)
*B65D 90/10* (2006.01)
*E01C 19/08* (2006.01)

(52) U.S. Cl.
CPC ..... *B65D 90/0033* (2013.01); *B65D 90/10* (2013.01); *B65D 90/16* (2013.01); *E01C 19/08* (2013.01)

(58) Field of Classification Search
USPC ..... 432/108, 111, 117; 34/135–137; 104/45; 222/167, 168, 185.1; 248/349.1; 220/1.5; 52/192–197
See application file for complete search history.

(56) References Cited

U.S. PATENT DOCUMENTS 3,595,508 A * 7/1971 Knight ..... B65D 88/128 296/15
4,745,952 A * 5/1988 French ..... B60P 7/132 141/1
4,775,275 A * 10/1988 Perry ..... B28C 7/0495 366/18
5,265,748 A * 11/1993 Furukawa ..... B65D 88/121 220/1.5
5,292,012 A * 3/1994 Davis ..... B60P 3/2205 211/85.18
5,362,193 A * 11/1994 Milstead ..... B65D 88/30 414/332
5,820,257 A * 10/1998 Musil ..... B28C 7/0053 366/22
6,186,654 B1 * 2/2001 Gunteret, Jr. ..... B01F 5/265 366/18
6,382,446 B1 * 5/2002 Hinkle ..... B65D 88/128 220/1.5
6,474,926 B2 * 11/2002 Weiss ..... B28C 7/0495 414/332
2003/0194273 A1 * 10/2003 Lloyd ..... E01C 23/065 404/83
2004/0074918 A1 * 4/2004 Le Roy ..... B65D 88/128 222/1
2004/0124711 A1 * 7/2004 Muchow ..... F03D 9/007 307/64
2005/0260062 A1 * 11/2005 Boasso ..... B28C 7/0084 414/332
2008/0173531 A1 * 7/2008 Kesler ..... C10G 7/003 203/39
2008/0298160 A1 * 12/2008 Kay ..... B01F 7/163 366/23
2009/0264561 A1 * 10/2009 Carlson ..... C08L 21/00 524/68
2010/0193077 A1 * 8/2010 Nelson ..... B65D 88/121 141/350
2011/0070062 A1 * 3/2011 Thompson ..... B65D 88/128 414/800
2014/0144394 A1 * 5/2014 Chandler ..... F24H 1/08 122/14.2
2014/0224705 A1 * 8/2014 Minor ..... G21F 5/012 206/595
2014/0238683 A1 * 8/2014 Korach ..... E21B 43/267 166/308.1
2015/0135636 A1 * 5/2015 Ayres ..... B07B 15/00 52/745.03

* cited by examiner

PORTABLE ASPHALT EMULSION STORAGE SYSTEM

PRIORITY

This application claims the benefit of U.S. Provisional Application Ser. No. 62/144,292, filed on Apr. 7, 2015, which is hereby incorporated herein by reference in its entirety.

FIELD

The present invention relates generally to storage systems, and more particularly, to portable asphalt emulsion storage facilities capable of storing asphalt emulsions at sub-zero temperatures.

BACKGROUND

Asphalt emulsions have many uses. One typical use is in road repair. In one such example, a water-based asphalt emulsion is mixed with aggregate to perform spray injection patching of potholes in roadways. To perform spray injection patching, a truck towable trailer is provided, which includes a heated tank containing the emulsion. The emulsion is pumped from the tank to a spraying wand where the emulsion is mixed with the aggregate as the emulsion is applied to the target area of the roadway.

The tank for the truck towable trailer can only hold a limited amount of emulsion (e.g. 300 gallons) because the tank must be able to be safely transported on public roadways with typical towing vehicles owned by most cities and states. Thus, the tank must be refilled with some frequency. This requires the tank to be towed to a refill facility, which is often in an inconvenient location. Refilling stations are often inconvenient (i.e. a considerable distance from the roadway repair work being performed) because they are in fixed locations not typically near the roadway work being performed. Therefore, the truck driver must take the time to drive to and from the work site when refilling the towed tank.

Providing a conveniently located storage tank is not often possible because the emulsion must be maintained at an elevated temperature (e.g. 125-175 degrees F.) in order to keep the emulsion in its flowable state. Thus, in cold weather, and particularly sub-freezing temperature weather, the emulsion must be kept heated. Conventional storage systems are, therefore, not suitable for being exposed to cold weather. And it is not financially feasible to move a permanent storage facility or to erect many new permanent facilities.

Therefore, there is a need to provide a portable storage system for asphalt and other like material that is required to be maintained at a particular constant heated temperature even in sub-zero ambient temperatures.

SUMMARY

The disclosure includes a portable storage system for asphalt and other like material that is required to be maintained at a particular constant heated temperature even in sub-zero ambient temperatures. The system may include an exterior covering over a frame to define an enclosure. The frame defines an interior space where an insulated tank resides. The tank is heated. The interior of the enclosure may be heated. Rails provided along a vertical surface of the enclosure and extending above the roof of the enclosure allow the entire system to be loaded as a roll-off load on a truck. A plurality of lugs with apertures therethrough extend beyond the exterior surface of the enclosure to enable the enclosure to be lifted by cranes and tied down during transport.

One or more access doors or hatches can be provided to the enclosure to permit access to the interior of the enclosure.

Additional heater components can be provided to heat the interior of the enclosure outside of the tank.

The disclosure also includes a method of portably storing flowable material in environments with sub-freezing temperatures. The method includes providing an enclosure having an interior. A storage tank is provided within the enclosure. The storage tank includes a heat exchanger disposed within the tank to heat any contents of the tank. A heating system is provided to heat the interior of the enclosure. The enclosure is rotated from a vertical orientation to a horizontal orientation such that a pair of rails protrudes below the enclosure. The enclosure is loaded onto a transport vehicle in the horizontal orientation. The enclosure is offloaded from the transport vehicle and rotated back to the vertical orientation. The enclosure further can be lifted via one or more lugs protruding from the enclosure.

Additional features of certain embodiments will be described throughout this application.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
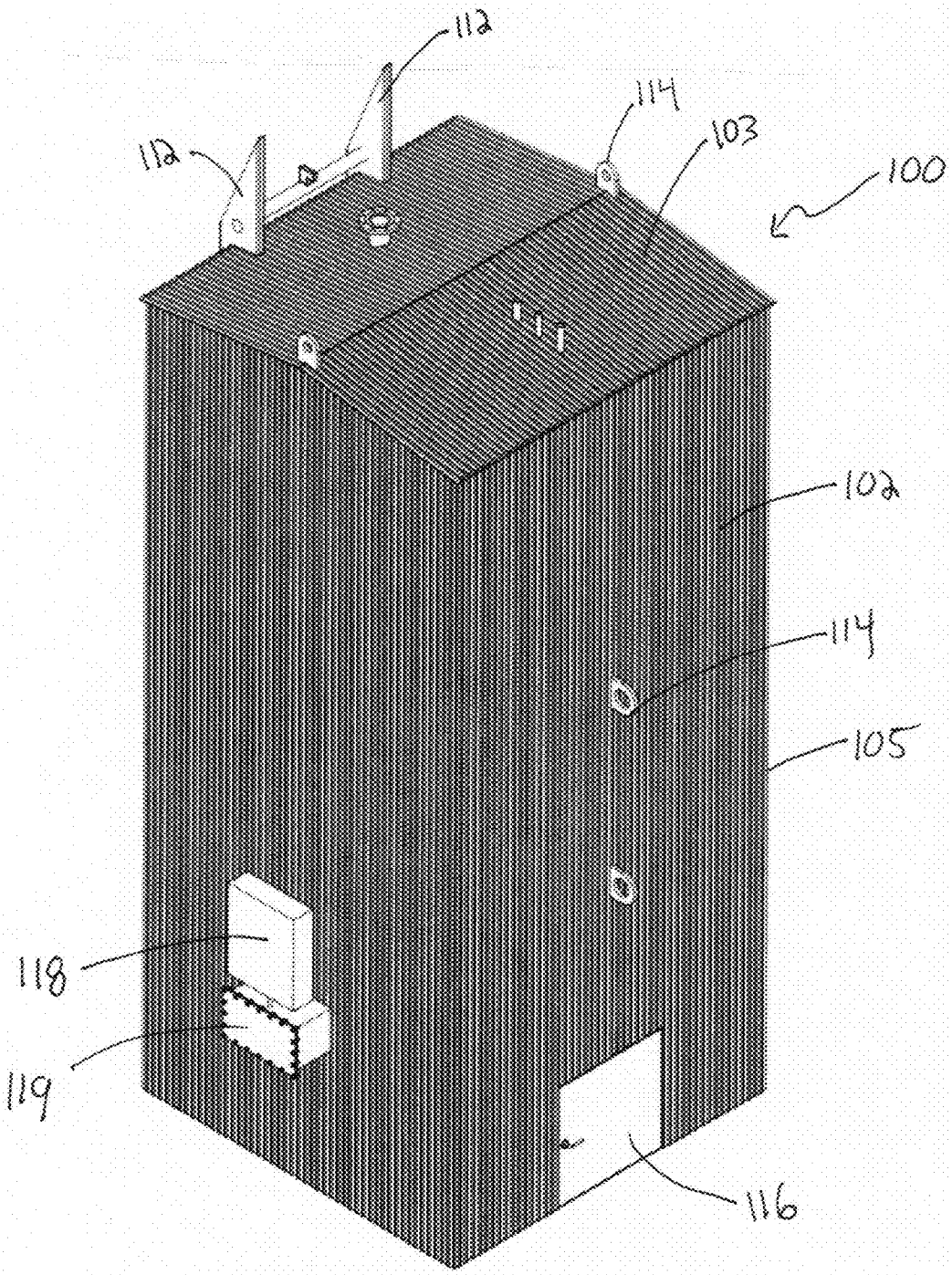
FIG. 1 is a perspective view of an enclosure for a portable asphalt emulsion storage system according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Figure 2:
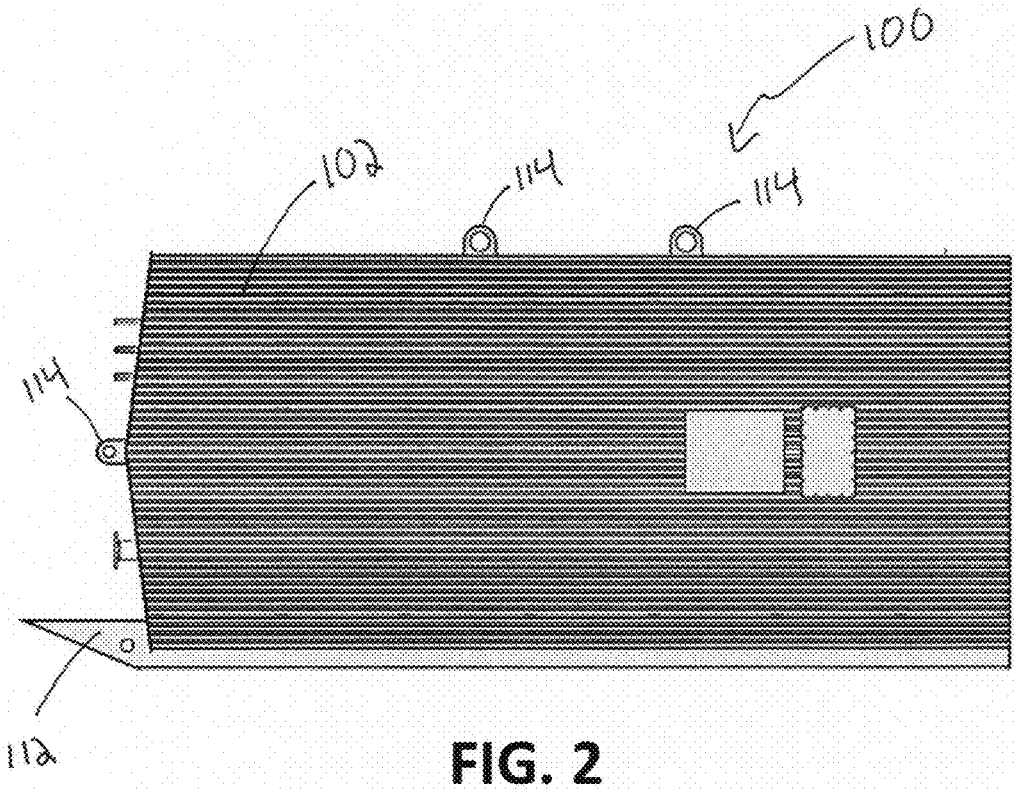
FIG. 2 is a side view of the enclosure system of FIG. 1 shown in a horizontal orientation for transport according to certain embodiments.
Figure 3:
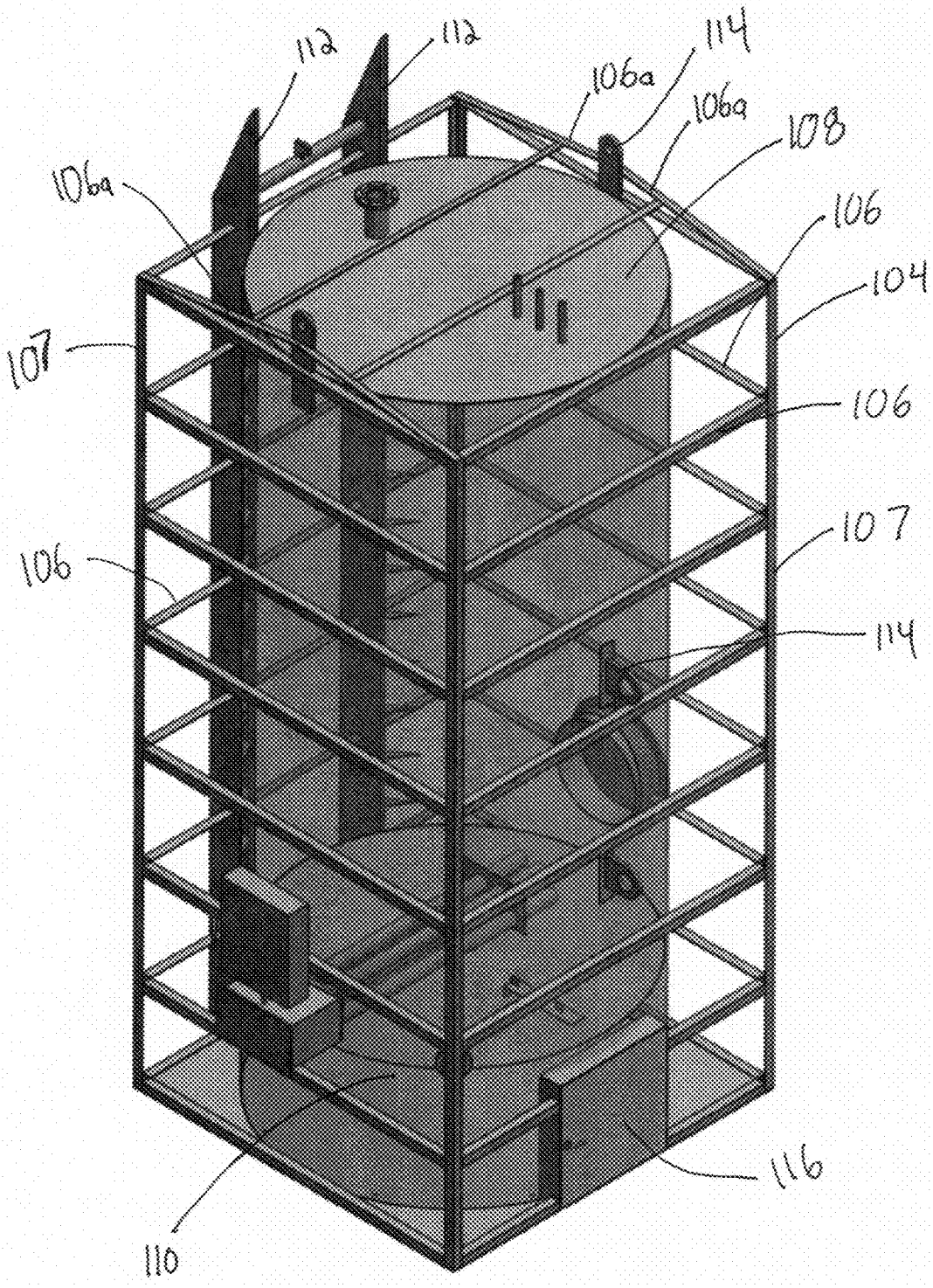
FIG. 3 is the enclosure of FIG. 1 with the outer panels removed.
Figure 4:
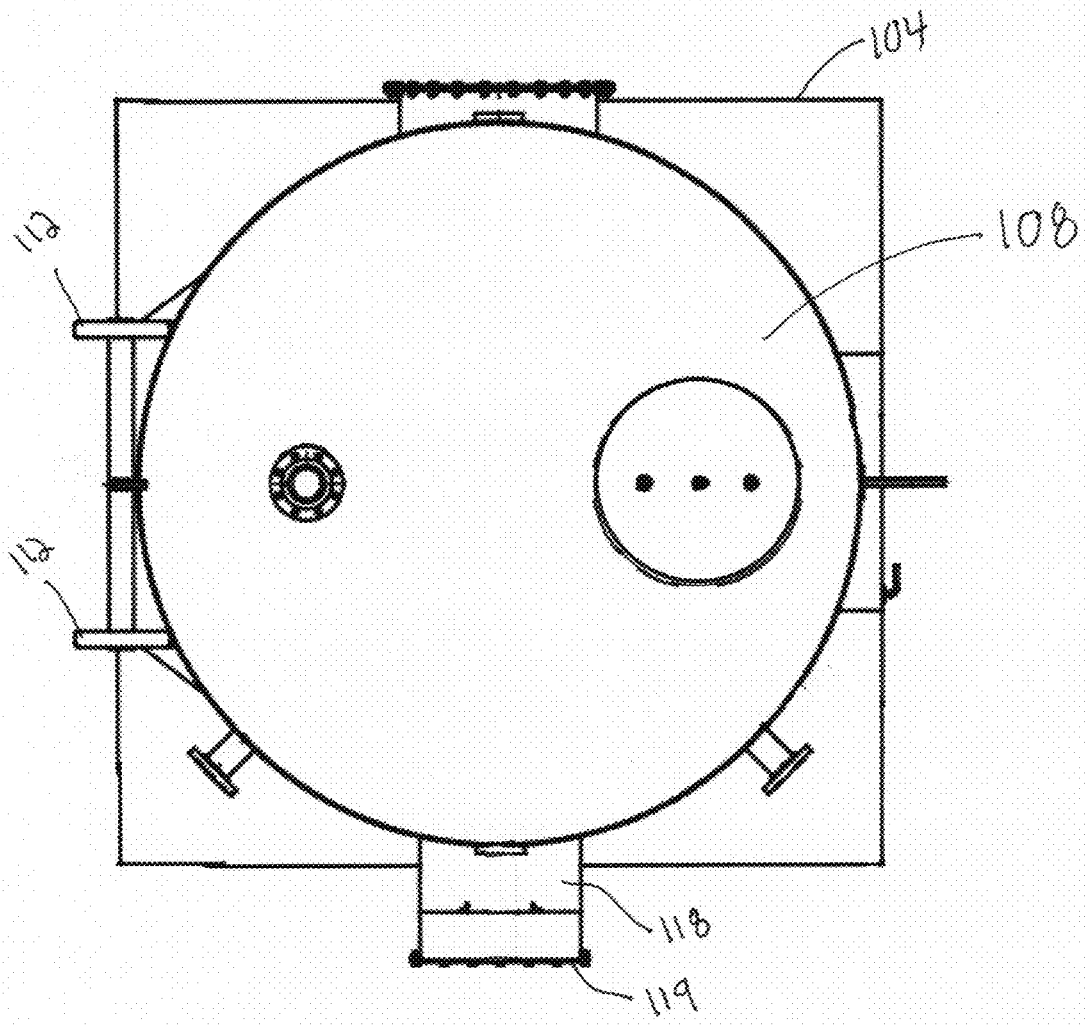
FIG. 4 is a top view of an enclosure for a portable asphalt emulsion storage system according to certain embodiments.
Figure 5:
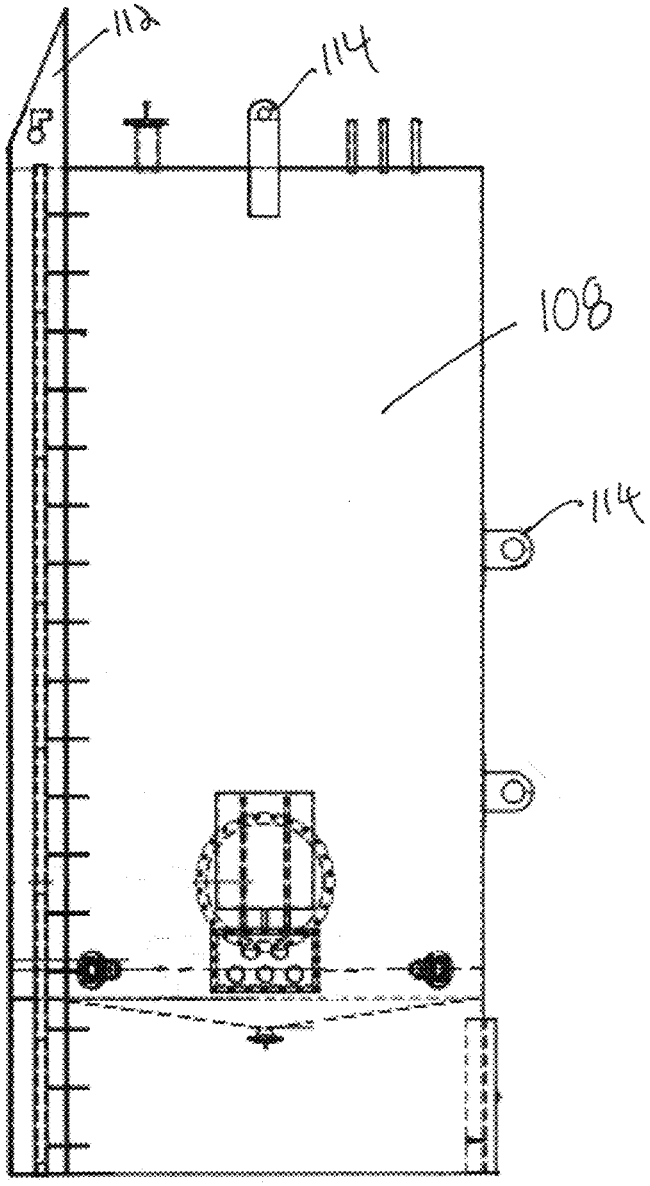
FIG. 5 is a side view of an enclosure for a portable asphalt emulsion storage system according to certain embodiments.
Figure 6:
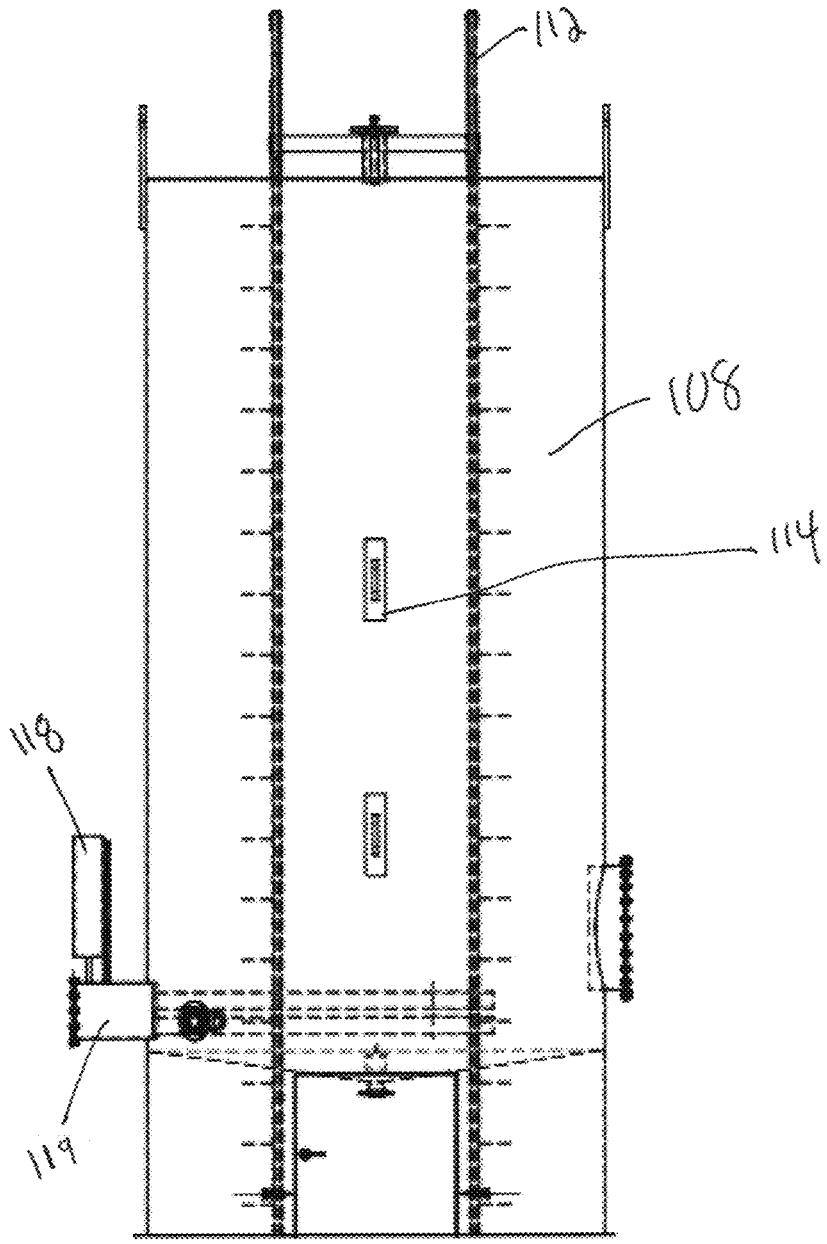
FIG. 6 is a front view of an enclosure for a portable asphalt emulsion storage system according to certain embodiments.
Figure 7:
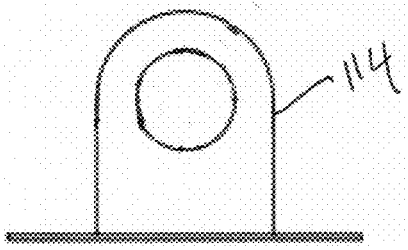
FIG. 7 is a side view of a side lug for an enclosure for a portable asphalt emulsion storage system according to certain embodiments.
Figure 8:
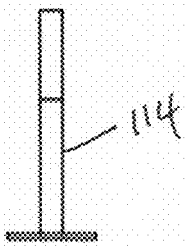
FIG. 8 is an end view of a side lug for an enclosure for a portable asphalt emulsion storage system according to certain embodiments.
Figure 9:
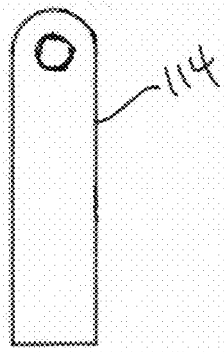
FIG. 9 is a side view of a top lug for an enclosure for a portable asphalt emulsion storage system according to certain embodiments.
Figure 10:
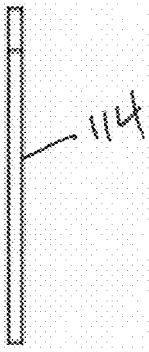
FIG. 10 is an end view of a top lug for an enclosure for a portable asphalt emulsion storage system according to certain embodiments.
Figure 11:
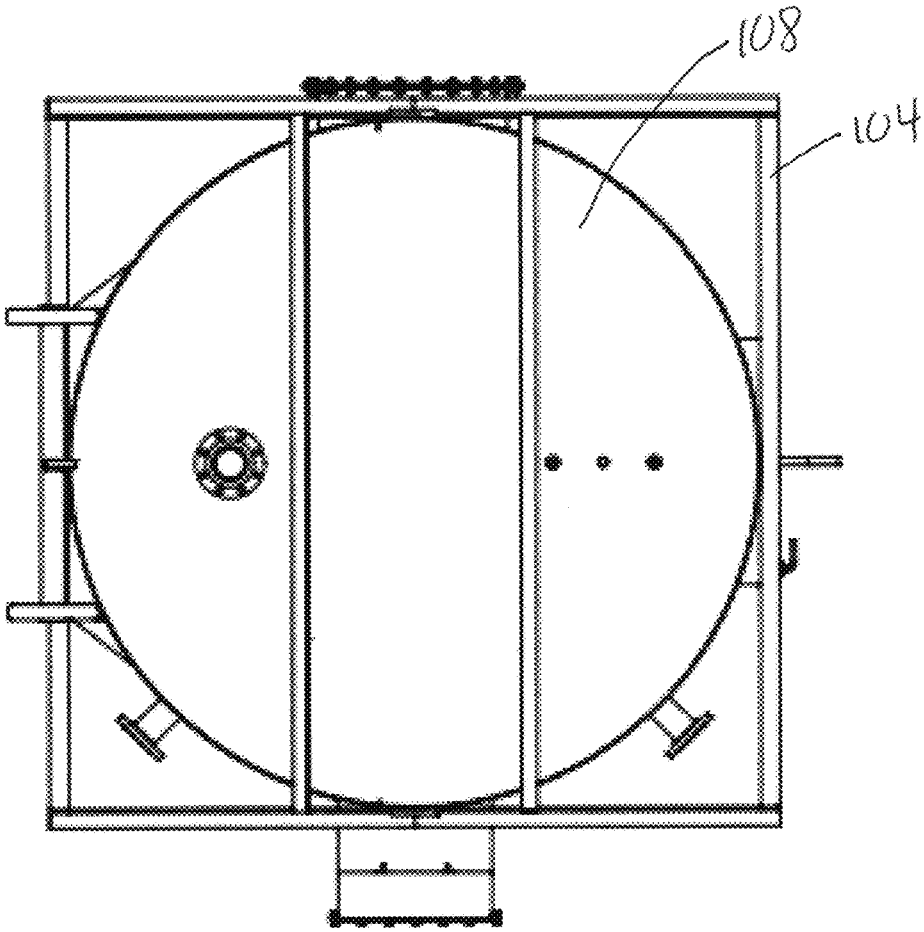
FIG. 11 is a top view of an enclosure for a portable asphalt emulsion storage system according to certain embodiments.
Figure 12:
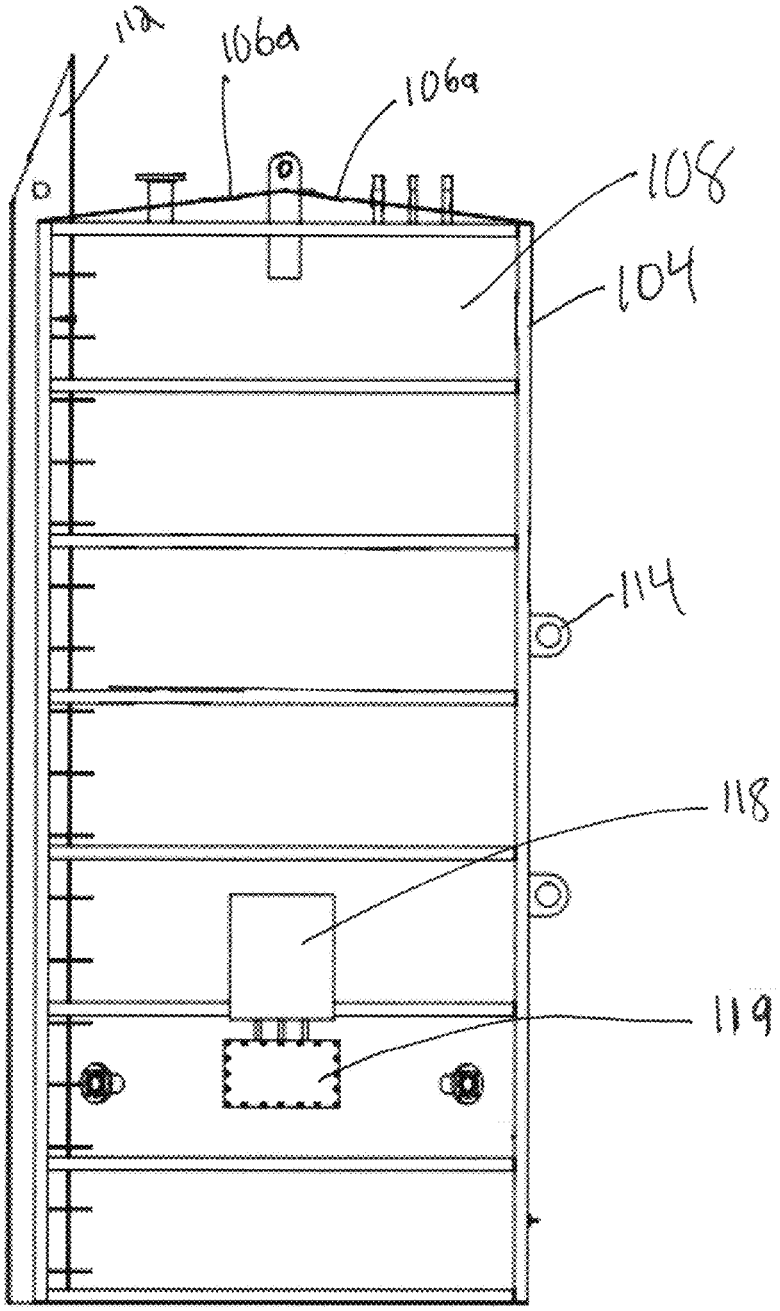
FIG. 12 is a side view of an enclosure for a portable asphalt emulsion storage system according to certain embodiments.

Referring specifically to FIGS. 1-3 and generally to all of the figures, the portable asphalt emulsion storage system 100 includes an exterior covering 102 over a frame 104 to define an enclosure 105. The covering can be a plurality of metal, fiberglass, plastic or composite panels fastened to the frame 104.

The frame 104 comprises a plurality of vertically spaced apart horizontal frame members 106 spanning between vertical corner members 107. The frame 104 defines an interior space where an insulated tank 108 resides. The exterior covering 102 panels are secured to the frame members 106, 107. The top horizontal frame members **106*a* can be angled upward from the horizontal to define a pitch to the roof panels 103 of the exterior covering 102**.

In one example embodiment, a heating system 110 is disposed inside the tank 108, which is disposed inside of the enclosure 105. The heating system 110 is sized to heat the tank contents by circulating heated liquid though heating pipes in communication with the tank 108.

Figure 16:
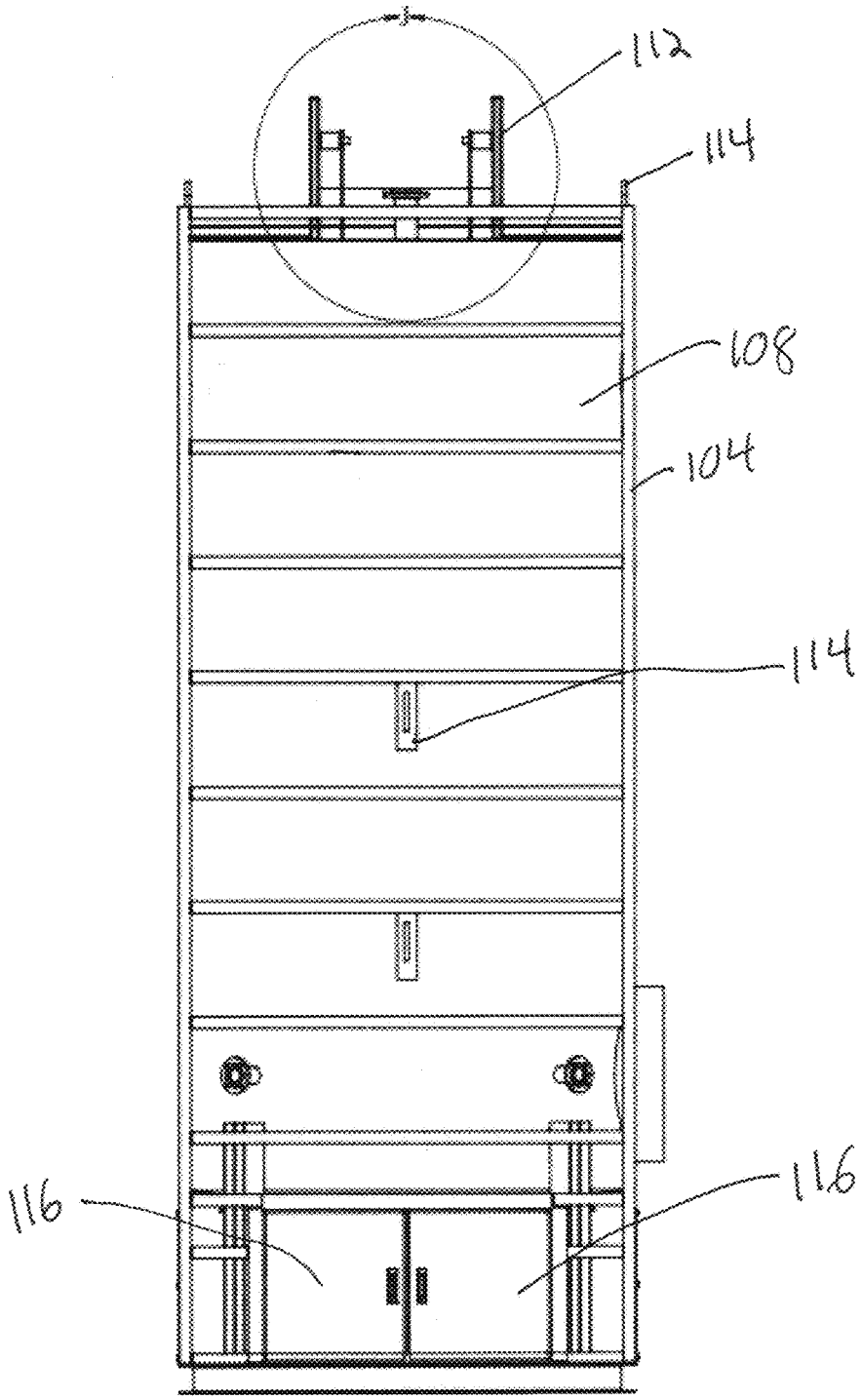
FIG. 16 is a front view of an enclosure for a portable asphalt emulsion storage system according to certain embodiments.
Figure 17:
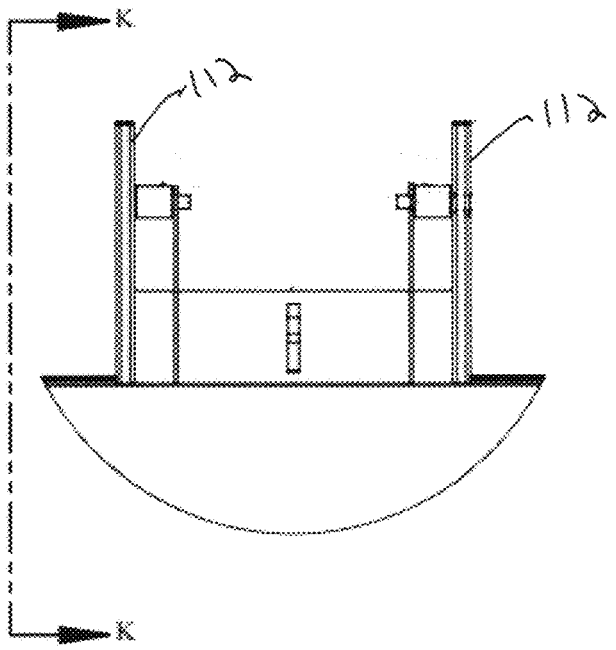
FIG. 17 is a view of detail J indicated in FIG. 16.
Figure 18:
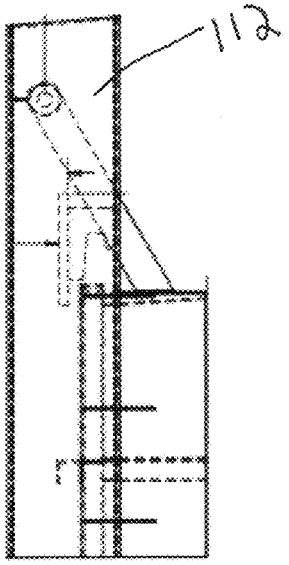
FIG. 18 is a section view along line K-K in FIG. 17.
Figure 19:
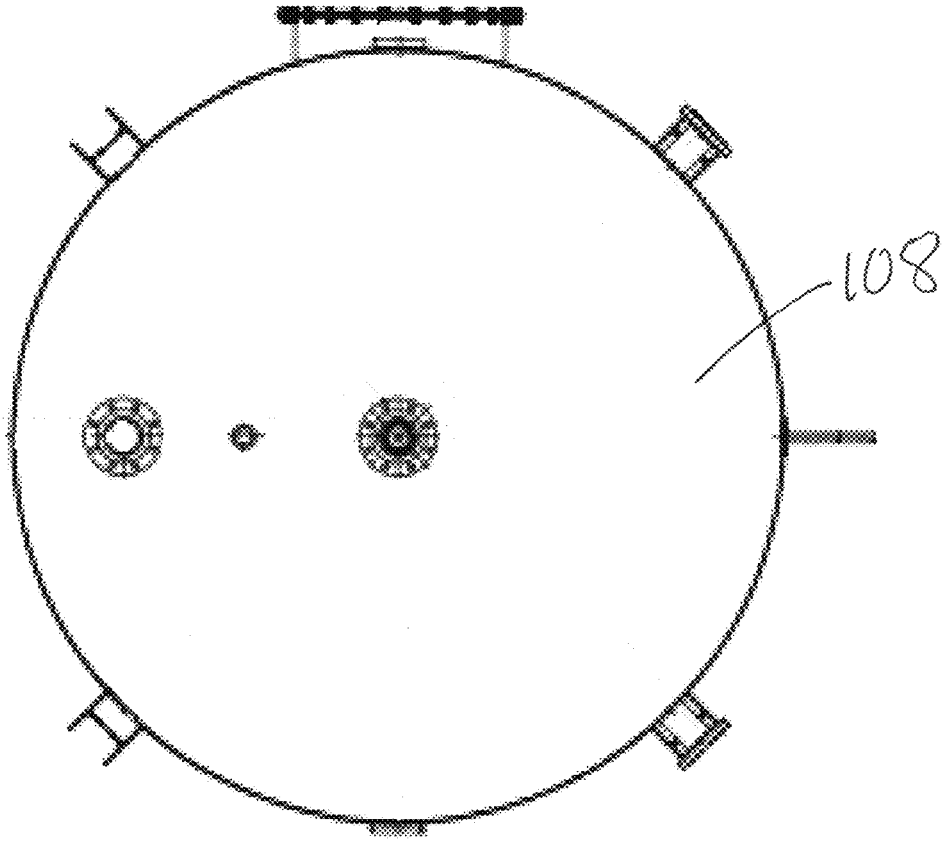
FIG. 19 is a top view of a tank for a portable asphalt emulsion storage system according to certain embodiments.

A pair of rails 112 are secured to the frame along the rear side of the frame. The rails 112 extend from a base of the enclosure upward vertically and protrude above the top of the roof 103 of the enclosure. FIGS. 16-18 illustrate the engagement features provided to the externally-protruding portion of the rails for allowing the rails to be engaged by roll-off dumpster clamps of a vehicle.

The rails 112 are rigid beams (e.g. steel) and are laterally spaced apart by a distance to allow the entire portable asphalt emulsion storage system 100 to be transported flat by truck like a roll-off dumpster or on a flat train car in a horizontal orientation. FIG. 1 shows the system 100 in the normal vertical or upright orientation. FIG. 2 shows the system 100 in a horizontal orientation.

As can be seen in FIGS. 1-2, the rails 112 protrude laterally outside of the exterior covering 102. Thus, the entire system 100 can be supported on the rails 112. Additional rails can be provided without departing from the scope of the invention.

A plurality of flanges or lugs 114 with apertures defined therethrough can be secured at various points along the frame members to enable the system 100 to be lifted by a crane. The lugs 114 protrude beyond the exterior covering 102. The lugs 114 are also useful for tying the enclosure down during transport. The lugs 114 can be located in any suitable position such as vertically spaced along a front vertical side and horizontally spaced apart at the top of the frame (at the highest point of the roof). The lugs 114 can also be positioned elsewhere, or additional (or fewer) lugs can be provided in addition to those positions shown in the figures. The lugs 114 can alternatively be attached directly to the tank 108.

Figure 15:
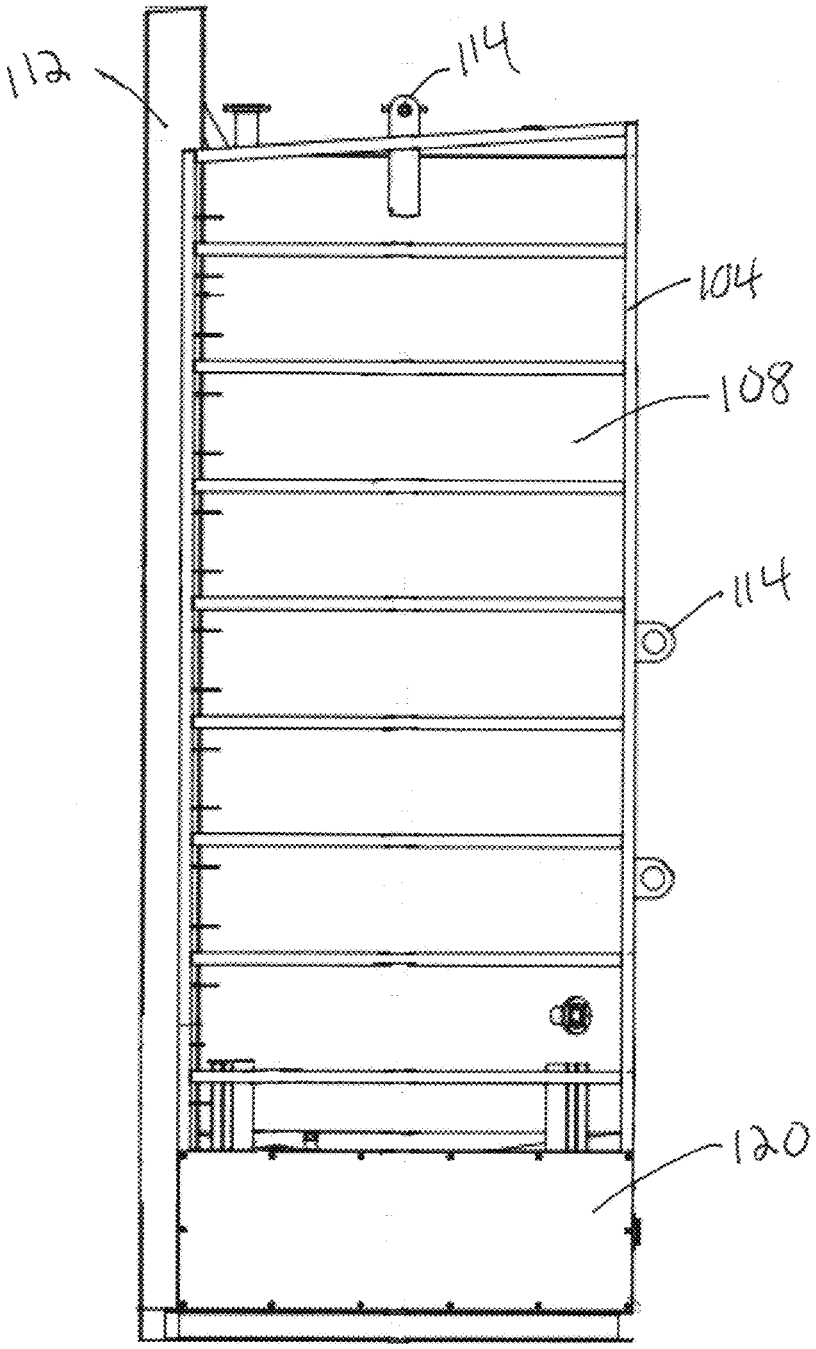
FIG. 15 is a rear view of an enclosure for a portable asphalt emulsion storage system according to certain embodiments.
Figure 29:
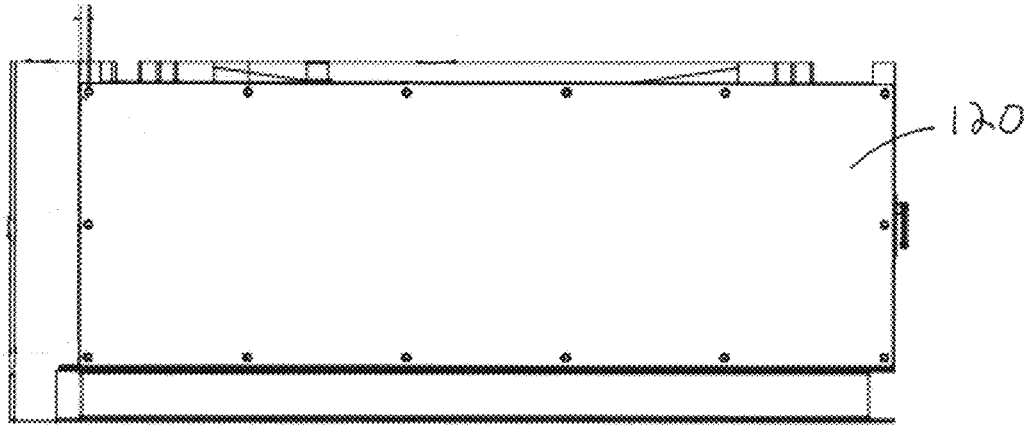
FIG. 29 is a front view of an access hatch for an enclosure for a portable asphalt emulsion storage system according to certain embodiments.

A bottom access door 116 is provided to the enclosure to allow an operator to access the heating system or other equipment that may reside under the tank 108 or at the base of the tank. In addition, or alternatively, a removable panel 120 (shown in FIGS. 15 and 29) can be provided to the enclosure for enabling a larger degree of access to the lower end of the enclosure. Additional access doors 116 and/or removable panels 120 can be provided without departing from the scope of the invention.

An exterior control panel 118 can be provided to the exterior of the enclosure for a user to interact with the system. The control panel 118 can include a graphical user interface, physical control knobs and switches, or both, or other suitable means for operating and interacting with the system. The controls for the heating system can be included as part of the control panel or can be housed in a separate control panel. The control panel 118 can be housed inside of a lockable hatch to prevent unauthorized access.

A dispensing/filling port is provided inside of a secured enclosure or panel 119 in the exterior of the enclosure. The port is in fluidic communication with the contents of the tank 108. The dispensing/filling port allows the user to access the tank contents to refill his or her towed application unit. The port can also be used in a reverse direction to fill the tank 108. Alternatively, separate dispensing and filling ports can be provided.

The entire system 100 can be electrically powered. For example, 208V single phase power or 240V three-phase power can be supplied to power the heater, pump, electrical systems, agitator, etc. Alternatively, a fuel-powered power generator (e.g. gas, diesel, propane, natural gas, etc.) can be coupled to the system 100. The heating system can be fuel-powered. Batteries and solar cells can also be used to supply the power necessary for one of more aspects of the system. A hybrid combination of any of the preceding can also be utilized. Multiple redundant power systems can also be provided from a combination of the foregoing.

The system 100 is configured to allow for the outdoor storage of asphalt emulsion or any other liquid that needs to be kept at an elevated temperature (e.g. over 100° F.) while being stored in an environment that might experience sub-freezing (and even sub-zero ° F.) temperatures.

In an example embodiment, the heating system 110 can be configured as a radiant glycol-based heating system that provides passive heat to the tank's contents. Such heating system can be located entirely within the enclosure and includes a 37 kW circulation heater that is placed external to the tank in a horizontal position. Glycol is pumped through a heating element using a glycol circulation pump to heat the contents of the tank.

In another example of the heating system, a boiler is provided to heat a liquid that is pumped through a heat exchanger tube 111 located inside of the tank 108. This arrangement is shown in FIGS. 19-23. The heat exchanger tube or coil 111 includes an inlet end 113 and an outlet end 115. The tube 111 has several lateral loops 117 between the ends. This arrangement provides an enhanced surface area for the heated tube to contact the tank contents and allows for the tube 111 to spread over much of the cross-sectional area in the plane where the tube 111 lies.

Figure 30:
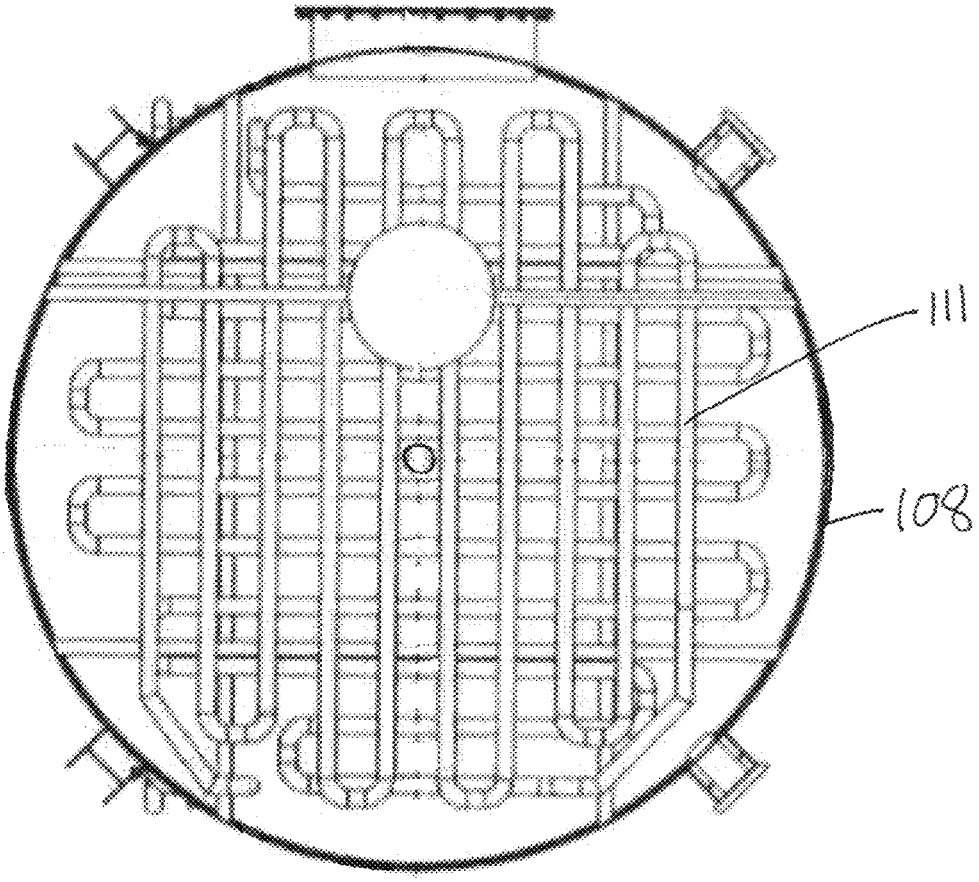
FIG. 30 is a top internal view of a tank for a portable asphalt emulsion storage system according to certain embodiments.
Figure 31:
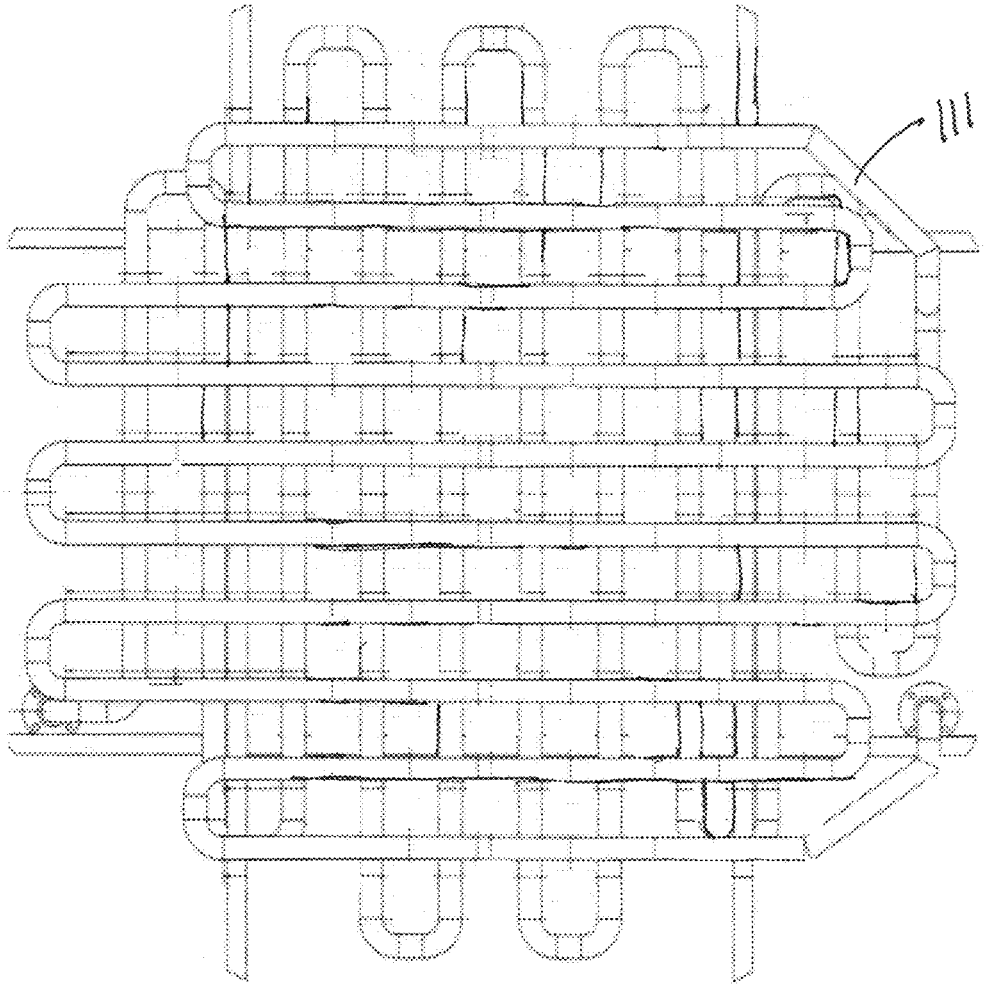
FIG. 31 is a top view of a portion of a heating system for a portable asphalt emulsion storage system according to certain embodiments.
Figure 32:
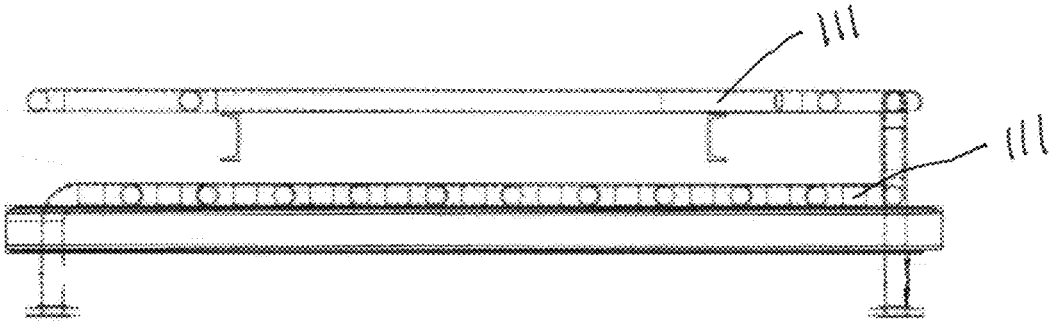
FIG. 32 is a side view of a portion of a heating system for a portable asphalt emulsion storage system according to certain embodiments.

In a further alternative illustrated in FIGS. 30-32, the tube 111 comprises a double layer of heating coils located inside of tank for greater heat distribution. A single inlet and outlet can connect the entirety of the coils, or each later can have its own inlet/outlet. Additional layers of coils can be provided without departing from the scope of the invention.

A pumping system is also disposed adjacent to the tank 108. The pumping system includes a 2 inch electrically driven pump that is configured for asphalt emulsion as is known in the art. The pump system can also be a 3 inch, 4 inch or other size without departing from the scope of the invention. The pump has the capability to run in either direction to allow for loading or unloading of material to/from the tank. The pump includes jacketed heads that allow the heated glycol to be pumped through the main areas of the pump to keep it hot for cold weather use.

The system 100 can include a means to measure the level of material in the tank. In one example embodiment the level is monitored via a Pulse Burst Radar Level Transmitter that is designed to be used in high temperature applications. The level monitor can be remotely monitored from any location, including via an exterior control panel and wirelessly via a central computer remote from the storage system's location when coupled to the level transmitter.

In another embodiment, a manual float tank level gauge can be used to provide a level measurement for the material in the tank. Multiple level monitoring means can be provided simultaneously as well.

The control panel 118 is mounted on the outside of the enclosure. The control panel can be painted steel and have a NEMA 4 rating. The panel includes a high level alarm and low flow alarm that protects the heating system.

The tank controls for loading and unloading can be push button controls mounted on a 30 foot retractable cable reel. Both the controls and the cable reel can be NEMA 4 rated.

The fill hose is mounted on a steel reel that is rated for use with a variety of hot oil products. The hose can be heated to help maintain temperature of the dispensed product during the dispensing operation. The heating can be by means of electric resistance wires or by circulating a heated liquid through a jacketed hose.

All external piping within the building can be heated by means of a heat trace cable and can be insulated.

The tank comprises ¼ inch steel that is rolled and welded at the seams. It has a conical bottom design to allow for 100% tank drainage and to avoid any residue build-up in the tank. The tank 108 can be insulated. In one embodiment, the tank 108 includes at least 2 inches of high density closed cell spray foam insulation which has an R-value of at least 12.

Figure 20:
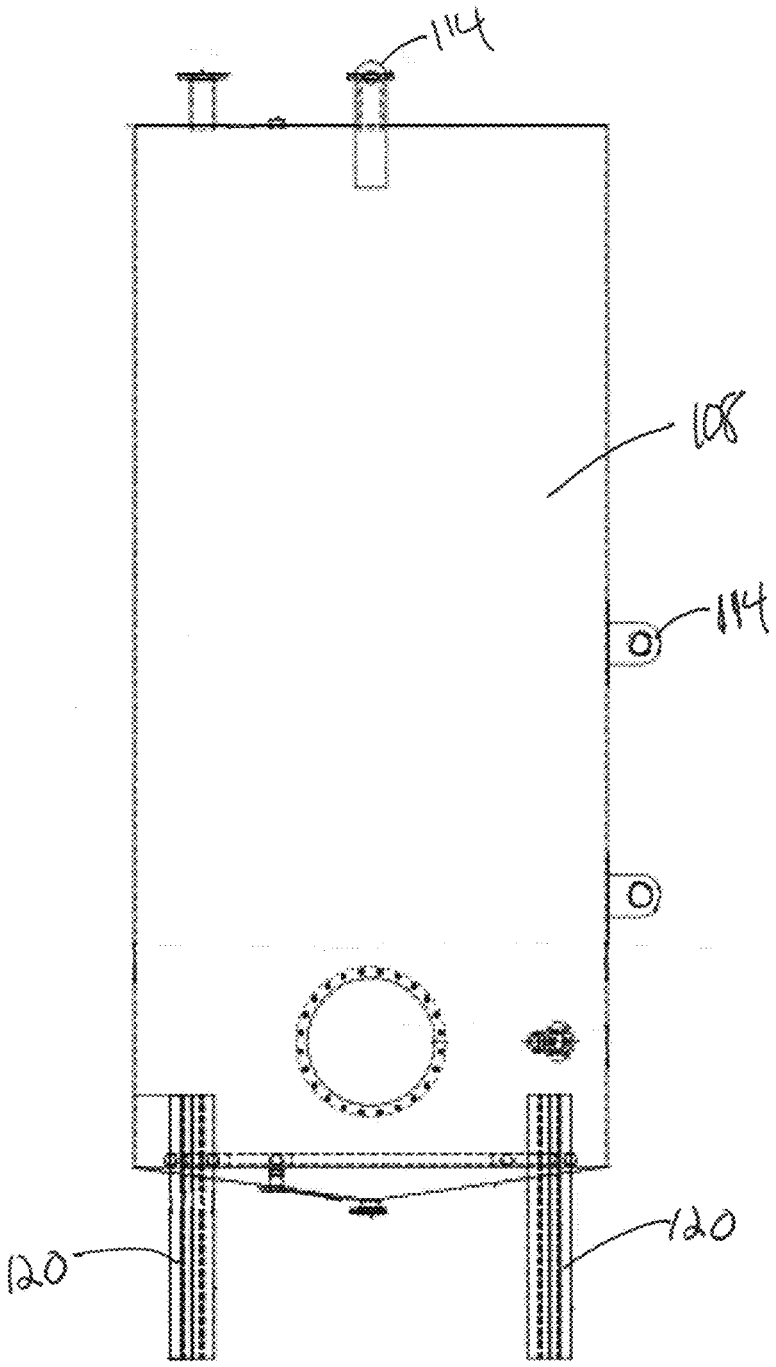
FIG. 20 is a side view of a tank for a portable asphalt emulsion storage system according to certain embodiments.
Figure 21:
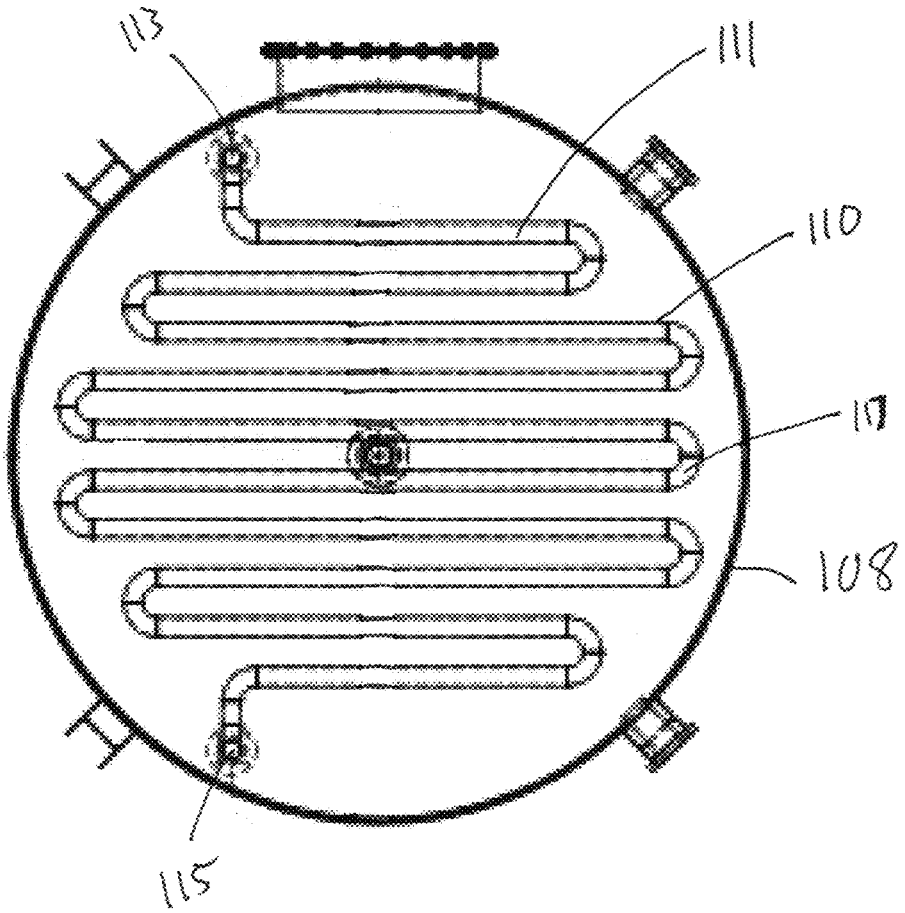
FIG. 21 is a top internal view of a tank for a portable asphalt emulsion storage system according to certain embodiments.
Figure 22:
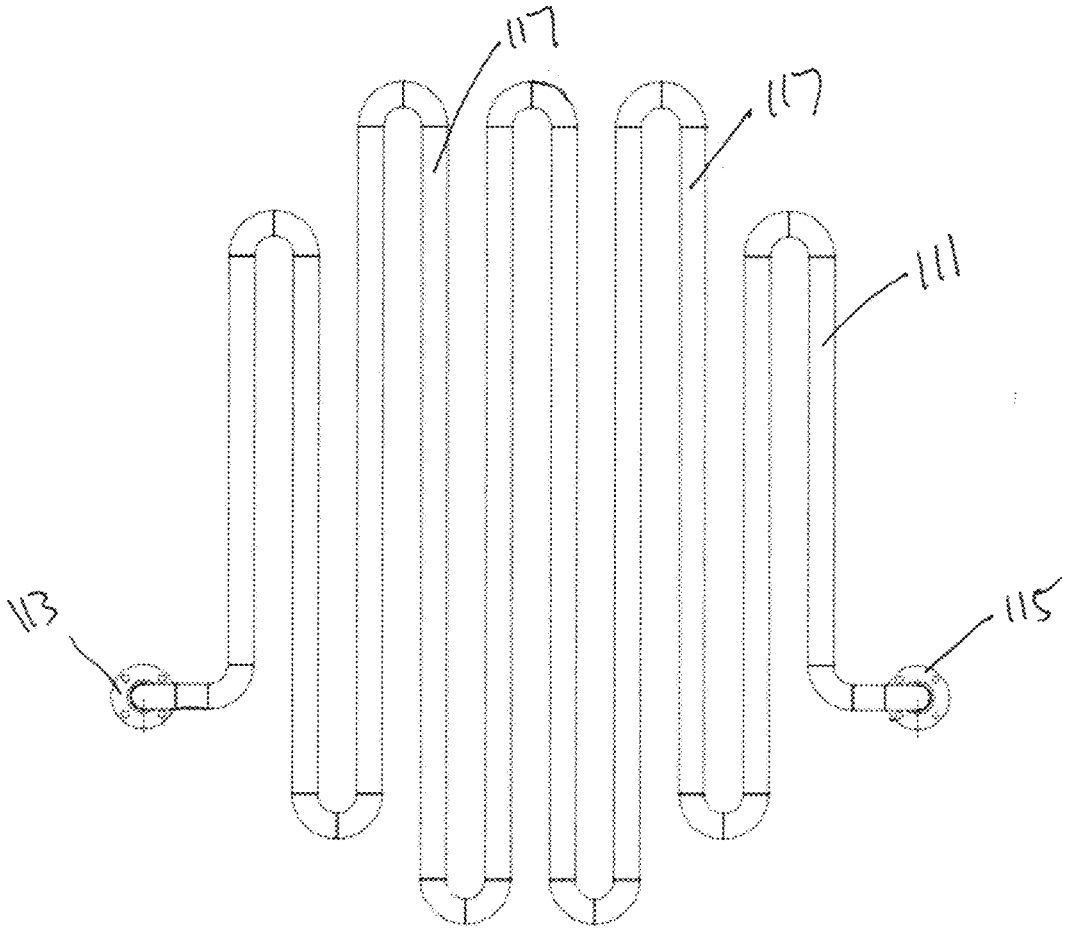
FIG. 22 is a top view of a portion of a heating system for a portable asphalt emulsion storage system according to certain embodiments.
Figure 23:
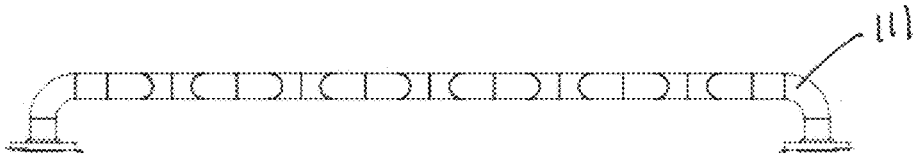
FIG. 23 is a side view of a portion of a heating system for a portable asphalt emulsion storage system according to certain embodiments.
Figure 33:
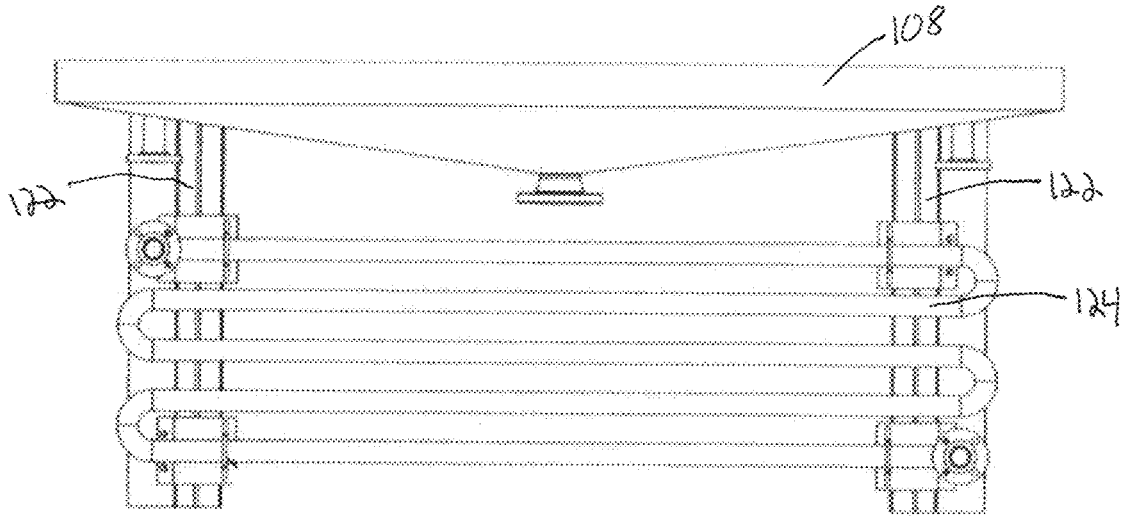
FIG. 33 is a front view of an external heating coil for an enclosure for a portable asphalt emulsion storage system according to certain embodiments.
Figure 34:
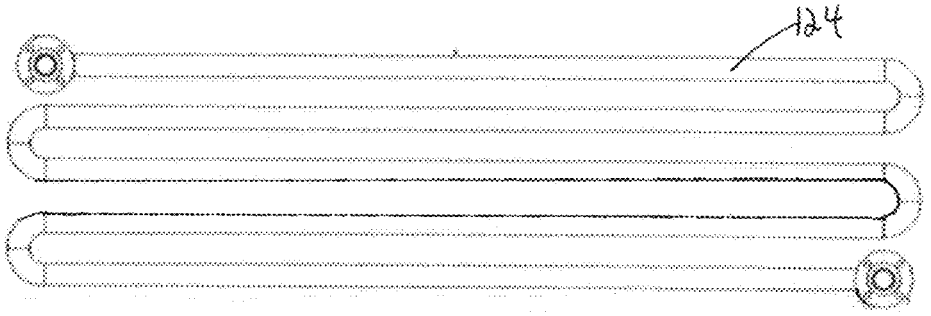
FIG. 34 is a front view of an external heating coil for an enclosure for a portable asphalt emulsion storage system according to certain embodiments.
Figure 35:
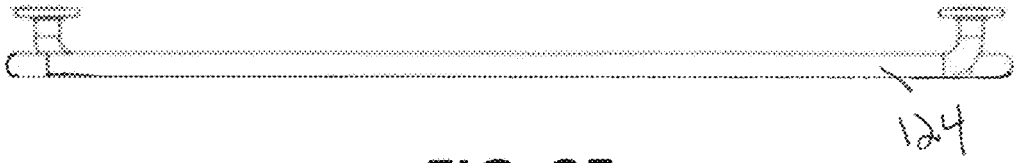
FIG. 35 is a side view of an external heating coil for an enclosure for a portable asphalt emulsion storage system according to certain embodiments.
Figure 36:
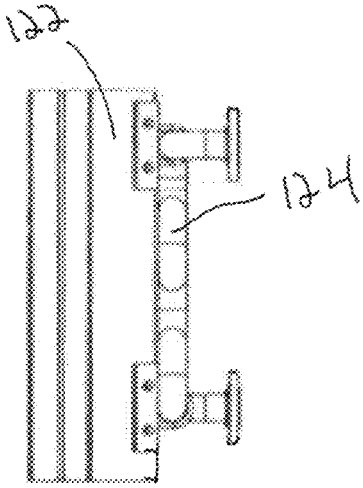
FIG. 36 is a side view of an external heating coil for an enclosure for a portable asphalt emulsion storage system according to certain embodiments.

The tank can be mounted on legs 122 or a frame as shown in FIGS. 20 and 33 to keep the tank at a height above the ground. The frame can be formed of steel.

The outer frame members 106 and 107 around the tank can be fabricated from ¼ inch steel angle that is welded in place around the tank.

The exterior or outer covering or panels 102 over the frame can be insulated with 2 inch board foam insulation having an R-rating of at least 7.5. The outer-facing exterior panels can be 22 gauge ribbed steel siding that is attached to the skeletal frame work with self-sealing steel screws. All of the seams are chalked with an adhesive sealant prior to assembly to ensure a watertight structure.

Referring to FIGS. 33-36, a further heating coil 124 can be provided to the legs 122 below the bottom of the tank.

This further heating coil functions as a radiating heater to heat the interior space of the enclosure 102. The coil 124 has a similar configuration to the coils inside of the tank. Heated liquid from the same source or another source is circulated through the coil. This radiating heating coil 124 is shown in a vertical configuration, but it can take other orientations or shapes in various alternative embodiments.

The heating coils disclosed herein can be formed of 2 inch schedule 40 carbon steel pipe that is welded or formed into the shapes indicated herein.

Figure 24:
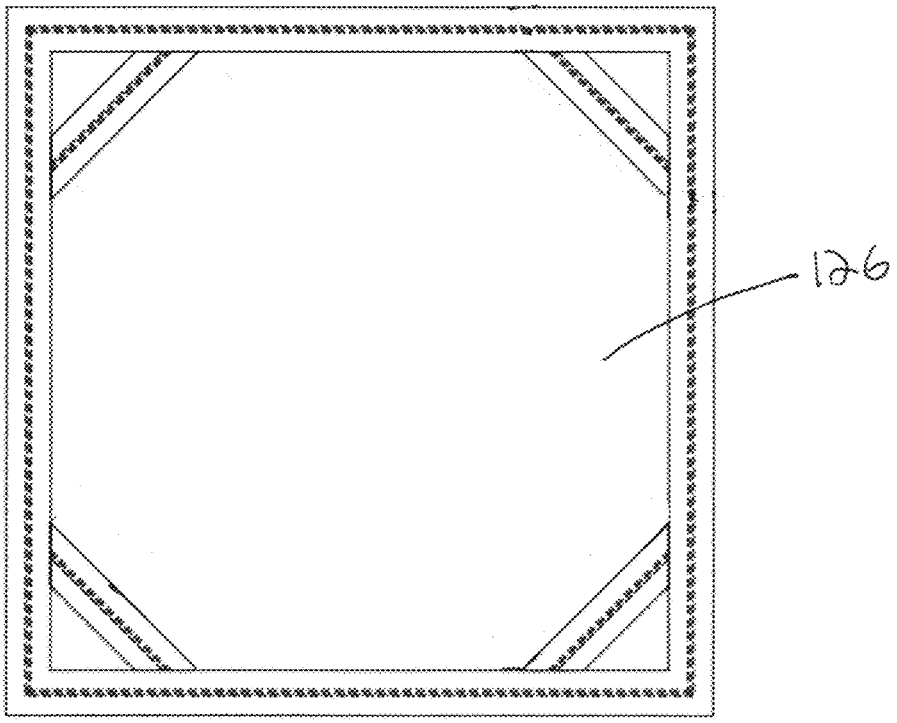
FIG. 24 is a top view of a base plate for an enclosure for a portable asphalt emulsion storage system according to certain embodiments.
Figure 25:
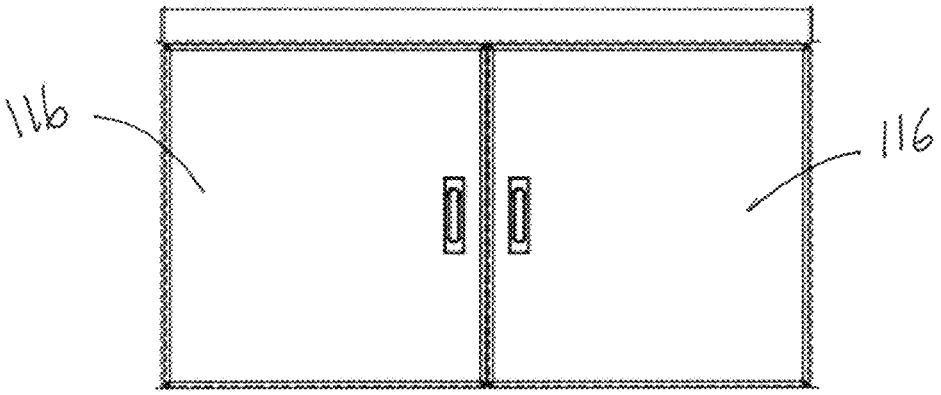
FIG. 25 is a front view of a pair of access doors for an enclosure for a portable asphalt emulsion storage system according to certain embodiments.
Figure 26:
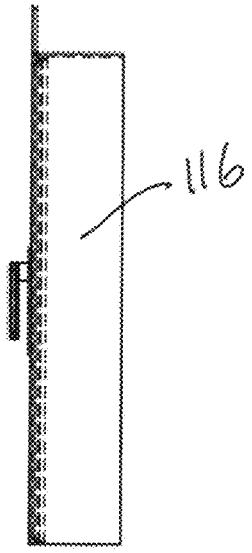
FIG. 26 is a side view of a pair of access doors for an enclosure for a portable asphalt emulsion storage system according to certain embodiments.
Figure 27:
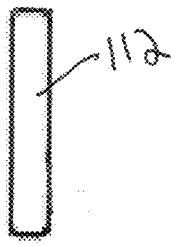
FIG. 27 is an end view of a rail for an enclosure for a portable asphalt emulsion storage system according to certain embodiments.
Figure 28:
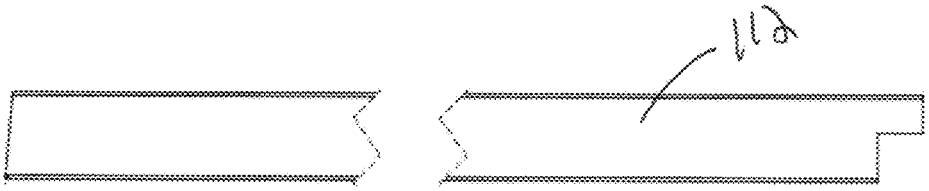
FIG. 28 is a top view of a rail for an enclosure for a portable asphalt emulsion storage system according to certain embodiments.

A bottom plate 126 can be provided to enclose the bottom end of the enclosure 102. A bottom plate is illustrated in FIG. 24. The plate 126 can be formed of steel and attached to the frame with fasteners or by welding.

When the system 100 is placed in the upright position for use, it will look like any other outbuilding. The exterior panels of the enclosure can be painted or manufactured in any color or pattern to match existing structures.

The pump controls can be mounted on a retractable cable reel that allows for one person to safely load and unload the tank. The tank fill hose can also be mounted on a retractable reel when not in use. The hose can be stored inside of the enclosure out of the elements.

The pulse burst radar level gauge ensures accurate measurement and provides remote level monitoring capability from any location.

Figure 13:
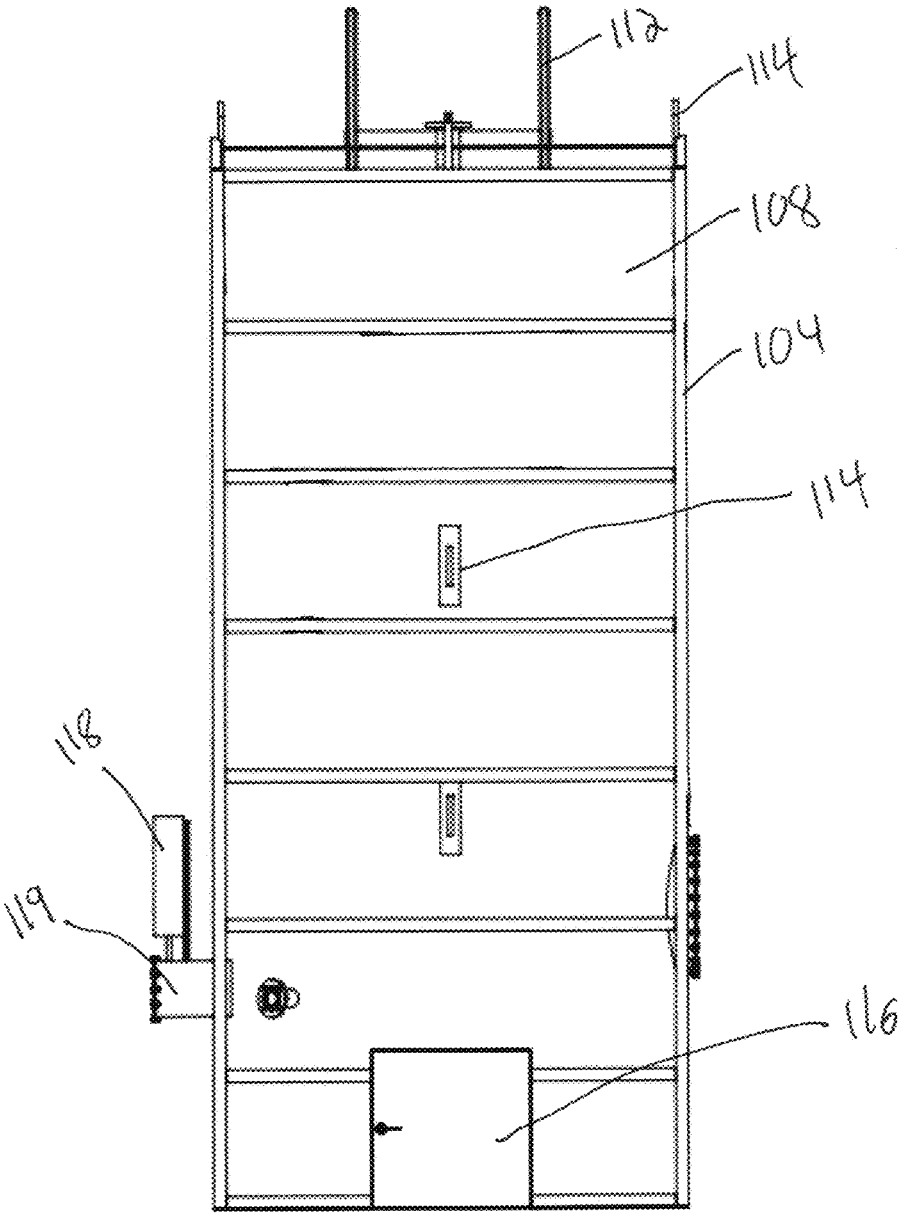
FIG. 13 is a front view of an enclosure for a portable asphalt emulsion storage system according to certain embodiments.
Figure 14:
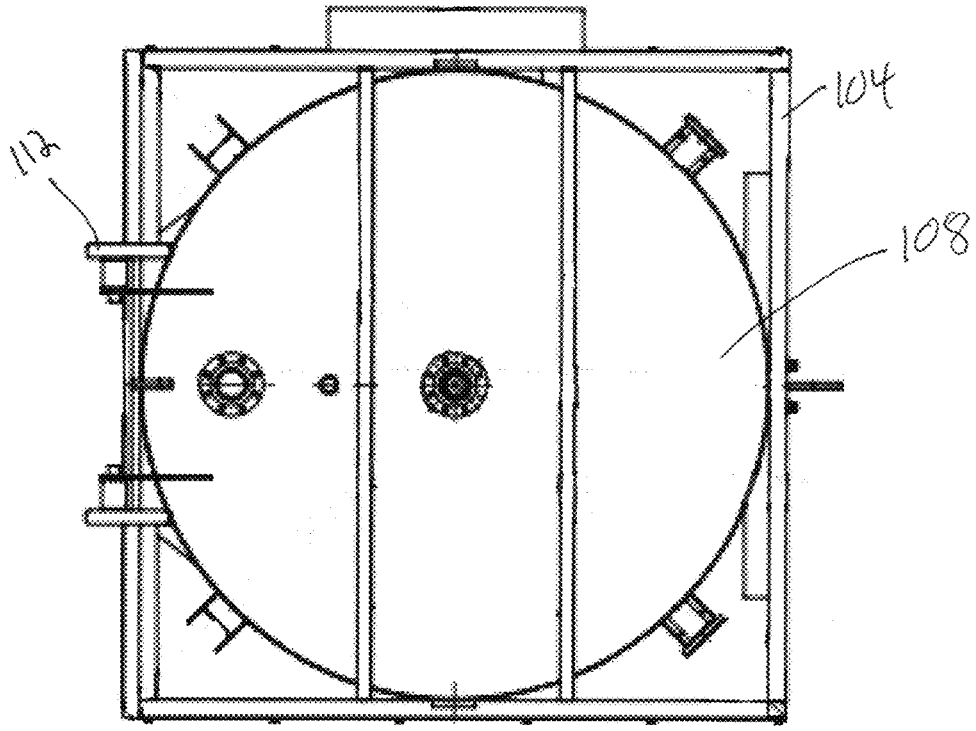
FIG. 14 is a top view of an enclosure for a portable asphalt emulsion storage system according to certain embodiments.

All of the main components are housed under the tank 108 in a heated environment. An access hatch 120 in the enclosure's side panels can be removed for easy access to all components for any needed repairs or maintenance (shown in FIG. 17). The enclosure includes single (FIG. 13) or double (FIG. 16) access doors 116 in certain embodiments that allow for easy access to the fill system. The doors are lockable for security.

The tank 108 and enclosure 102 can be formed in many different sizes and include heaters with many different power ratings. The inner tank can be manufactured out of different materials to allow for the storage of many types of products.

In certain embodiments, the tank can range from 2000 to 6000 gallons, however, larger and smaller tanks can be provided without departing from the scope of the invention. Additionally, the material storage inside of the enclosure can be configured as multiple individual smaller tanks. Each smaller tank can hold the same material, or the separate tanks can be configured to store different materials. If different materials, then separate pump and load/unload fluid paths can be provided within the enclosure.

The operator controls can include security access features and usage monitoring means such as a card reader system that will allow for self-serve customer use. A weight scale can be coupled to the control system to allow users to fill their tanks to specified weights as well.

A timer operated agitation System can be provided to the tank.

Certain embodiments of the present invention can provide certain features and benefits, including one or more of the following:

self-contained design allows for placement of tank at desired location with little containment issues and transportation is convenient since the tank itself is on a roll off frame for easy transportation from one location to the next;

below zero temperature storage of material;

self-contained heating unit prevents pumps from freezing;

pumping system easily accessible and self-contained;

unique loading/unloading procedure, including remote operation;

exterior panels of enclosure can be matched to fit design/style of buildings in tank location area;

no burners are used to heat tanks. Burners can cause damage to sensitive emulsion or other material sensitive to extreme temperature changes;

the tank is protected from the elements by the enclosure;

long term storage can be provided, especially in cold weather locations; and convenient placement of the system near work sites.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A portable asphalt emulsion storage system, comprising:

a frame defining an interior and an exterior;

an exterior covering disposed over the exterior of the frame on each of a plurality of vertical sides and a top side thereof, the exterior covering defining an enclosure;

a tank disposed within the interior of the frame and completely inside of the enclosure;

a heat exchanger tube disposed at least partially within the tank;

a first rail disposed along one of the vertical sides of the frame and extending vertically above the top side of the frame; and a second rail horizontally spaced apart from the first rail, disposed along the same vertical side of the frame as the first rail and extending vertically above the top side of the frame.

2. The system of claim 1, wherein each of the first rail and the second rail extend vertically along an entire height of the one vertical side of the frame and protrude horizontally outward beyond the exterior covering of the enclosure.

3. The system of claim 1, further comprising a lug extending outwardly beyond the exterior covering of the enclosure.

4. The system of claim 3, wherein a first lug extends horizontally outward opposite the location of the first and second rails.

5. The system of claim 4, wherein a second lug extends vertically upwards above the top side of the frame.

6. The system of claim 3, wherein a first lug extends vertically upwards above the top side of the frame.

7. The system of claim 3, wherein the first lug defines an aperture laterally through the first lug.

8. The system of claim 1, wherein the heat exchanger tube comprises a single horizontal layer of coils through which heated liquid can flow.

9. The system of claim 1, wherein the heat exchanger tube comprises at least two horizontal layers of coils through which heated liquid can flow.

10. The system of claim 1, further comprising a base plate enclosing a bottom side of the frame.

11. The system of claim 10, wherein the tank is disposed on a plurality of legs that span between the base plate and a bottom end of the tank.

12. The system of claim 1, wherein the tank is insulated and includes a conical bottom.

13. The system of claim 1, further comprising a further heating coil disposed external to the tank and within the enclosure.

14. The system of claim 13, wherein the further heating coil comprises a single layer of coils of a hollow tube.

15. The system of claim 1, further comprising an exterior control panel disposed within a control panel enclosure disposed along the exterior covering.

16. The system of claim 1, further comprising an access door in a vertical panel portion of the exterior covering to permit access to the interior.

17. A method of portably storing flowable material in environments with sub-freezing temperatures, the method comprising:

providing an enclosure having an interior;

providing a storage tank within the enclosure, the storage tank including a heat exchanger disposed within the tank to heat any contents of the tank;

providing a heating system for the interior of the enclosure;

rotating the enclosure from a vertical orientation to a horizontal orientation such that a pair of rails protrudes below the enclosure;

loading the enclosure onto a transport vehicle in the horizontal orientation;

unloading the enclosure from the transport vehicle; and rotating the enclosure back to the vertical orientation.

18. The method of claim 17, further comprising lifting the enclosure via a lug protruding from the enclosure.

19. A portable asphalt emulsion storage system, comprising:

a frame defining an interior and an exterior;

an exterior covering disposed over the exterior of the frame on each of a plurality of vertical sides and a top side thereof, the exterior covering defining an enclosure;

a tank disposed within the interior of the frame and completely inside of the enclosure;

a heat exchanger disposed within the tank;

a rail disposed along one of the vertical sides of the frame and extending vertically above the top side of the frame; and a lug extending outwardly beyond the exterior covering of the enclosure.

20. The system of claim 19, further comprising a heat exchanger tube that communicates with the heat exchanger disposed within the tank wherein the heat exchanger tube is disposed external to the tank and within the enclosure.

* * * * *